US009472330B2

(12) United States Patent
Shin et al.

(10) Patent No.: US 9,472,330 B2
(45) Date of Patent: Oct. 18, 2016

(54) HIGH SPEED SOLENOID

(71) Applicant: Hyundai Heavy Industries Co., Ltd., Ulsan (KR)

(72) Inventors: Dong Kyu Shin, Seoul (KR); Jong Sung Kang, Gyeonggi-do (KR); Dong Jin Cho, Seoul (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 26 days.

(21) Appl. No.: 14/511,561

(22) Filed: Oct. 10, 2014

(65) Prior Publication Data

US 2015/0102878 A1 Apr. 16, 2015

(30) Foreign Application Priority Data

Oct. 10, 2013 (KR) ..... 10-2013-0120419

(51) Int. Cl.
*H01F 5/00* (2006.01)
*H01F 7/18* (2006.01)
(Continued)

(52) U.S. Cl.
CPC ..... *H01F 7/18* (2013.01); *H01F 7/066* (2013.01); *H01F 7/1607* (2013.01)

(58) Field of Classification Search
CPC ..... H01F 7/081; H01F 7/0231; H01F 7/08; H01F 7/02; H01F 7/18; H01F 7/1607; H01F 7/066; F04B 17/04–17/048; H02K 33/18
USPC ..... 355/266
See application file for complete search history.

(56) References Cited

U.S. PATENT DOCUMENTS 3,519,095 A * 7/1970 Tomes ..... G01G 7/04 177/210 R
4,121,124 A * 10/1978 Hunt ..... H02K 33/18 310/13

(Continued)

FOREIGN PATENT DOCUMENTS

DE 102010013764 A1 10/2011
EP 239333 A2 9/1987

(Continued)

OTHER PUBLICATIONS

Extended European Search Report for European Patent Application No. 14188108.6, dated Feb. 9, 2015.

(Continued)

*Primary Examiner* — Mohamad Musleh
*Assistant Examiner* — Lisa Homza
(74) *Attorney, Agent, or Firm* — Locke Lord LLP; Christopher J. Capelli; Judy R. Naamat

(57) ABSTRACT

There is provided a high speed solenoid having enhanced response characteristics. The high speed solenoid includes: a movable shaft linearly movable in an axial direction; a movable coil unit coupled to the movable shaft; and a magnetic field forming unit forming a magnetic field in a direction perpendicular with respect to that of a current flowing in the movable coil unit, wherein when a current is applied to the movable coil unit, the movable coil unit is moved by a magnetic field formed by the magnetic field forming unit to move the movable shaft. According to the high speed solenoid, the weight of a moving part is significantly reduced, and since an electrical time constant is small, a response speed of the solenoid may be enhanced.

14 Claims, 4 Drawing Sheets

(51) Int. Cl.
*H01F 7/06* (2006.01)
*H01F 7/16* (2006.01)

(56) References Cited

U.S. PATENT DOCUMENTS

| | | | | | |
|---|---|---|---|---|---|
| 4,121,224 | A * | 10/1978 | Takeuchi | B41J 2/49 | 346/139 C |
| 4,138,121 | A * | 2/1979 | Nakajima | G11B 3/36 | 369/215.1 |
| 4,472,072 | A * | 9/1984 | Harada | B41J 2/28 | 101/93.05 |
| 4,606,313 | A * | 8/1986 | Izumi | B60W 10/06 | 123/357 |
| 4,634,126 | A * | 1/1987 | Kimura | A63F 7/26 | 273/121 A |
| 4,815,913 | A * | 3/1989 | Hata | H05K 13/0417 | 198/471.1 |
| 4,879,510 | A * | 11/1989 | Itoh | G01R 5/02 | 324/144 |
| 4,902,996 | A * | 2/1990 | Takahara | H02K 41/0356 | 335/222 |
| 4,983,045 | A * | 1/1991 | Taniguchi | B01F 11/0082 | 366/117 |
| 5,160,877 | A * | 11/1992 | Fujiwara | B25J 9/1015 | 310/90.5 |
| 5,301,875 | A * | 4/1994 | Gant | F02M 45/08 | 239/94 |
| 6,032,925 | A * | 3/2000 | Izuo | F01L 9/04 | 251/129.17 |
| 6,496,092 | B1 * | 12/2002 | Schnatterer | F16K 31/0679 | 251/129.09 |
| 7,038,443 | B2 * | 5/2006 | Proksch | B82Y 35/00 | 324/207.18 |
| 7,249,579 | B2 * | 7/2007 | Liang | F01L 9/04 | 123/90.11 |
| 2003/0205941 | A1 * | 11/2003 | Suzuki | H01F 7/1615 | 310/14 |
| 2004/0046632 | A1 * | 3/2004 | Kumano | C23C 18/02 | 336/233 |
| 2004/0051607 | A1 | 3/2004 | Rausch et al. | | |
| 2005/0057101 | A1 * | 3/2005 | Nakagawa | H01F 7/1615 | 310/12.24 |
| 2005/0103902 | A1 * | 5/2005 | Hornsell | F16K 31/0655 | 239/585.1 |
| 2005/0184618 | A1 * | 8/2005 | Lee | H02K 41/0354 | 310/273 |
| 2005/0231553 | A1 * | 10/2005 | Horsnell | F16K 31/0644 | 347/47 |
| 2008/0042322 | A1 * | 2/2008 | Choi | B29C 45/64 | 264/328.1 |
| 2008/0297288 | A1 * | 12/2008 | Irwin | H01F 7/1615 | 335/254 |
| 2012/0273706 | A1 * | 11/2012 | Kusunoki | G05D 16/2013 | 251/129.15 |
| 2015/0192213 | A1 * | 7/2015 | Nomichi | F16K 31/408 | 137/488 |
| 2016/0076464 | A1 * | 3/2016 | Vorih | F02D 13/0234 | 123/348 |

FOREIGN PATENT DOCUMENTS

| | | | |
|---|---|---|---|
| EP | 1502730 | A1 | 2/2005 |
| JP | S51106011 | A | 9/1976 |
| JP | S511153233 | A | 10/1976 |
| JP | S53-114625 | A | 9/1977 |
| JP | S61112175 | U | 7/1986 |
| JP | S62299010 | A | 12/1987 |
| JP | S622999010 | | 12/1987 |
| JP | H033175 | A | 1/1991 |
| JP | H033175 | U | 1/1991 |
| JP | H05191959 | A | 7/1993 |
| JP | 2001-217129 | A | 8/2001 |
| WO | WO-0241332 | A1 | 5/2002 |

OTHER PUBLICATIONS

Notice of Allowance for Korean Patent Application No. KR10-2013-0120419, dated Aug. 31, 2015.
Office Action for Japanese Application No. JP2014-207668, dated Sep. 29, 2015.
Office Action dated Jan. 30, 2015 for Korean patent application No. 10-2013-0120419.

* cited by examiner

HIGH SPEED SOLENOID

CROSS-REFERENCE TO RELATED APPLICATION

This application claims the benefit of Korean Patent Application No. 10-2013-0120419 filed on Oct. 10, 2013, with the Korean Intellectual Property Office, the disclosure of which is incorporated herein by reference.

BACKGROUND

The present disclosure relates to a high speed solenoid and, more particularly, to a high speed solenoid having enhanced response characteristics.

In general, a solenoid is a device in which a movable core moves in a linear mannerdue to a current flowing in a coil, to convert magnetic energy into kinetic energy. Solenoids are utilized in various industrial fields such as power devices, automobiles, hydraulic systems, etc.

FIG. 1 is a cross-sectional view of a related art solenoid.

Referring to FIG. 1, the related art solenoid includes an external fixed iron core 10, an internal fixed iron core 30, a movable iron core 40, and a coil 20.

In the related art solenoid, when a current is applied to the coil 20, attractive force works between the movable iron core 40 and the internal fixed iron core 30 by the current flowing in the coil 20, enabling the movable iron core 40 to move in a direction toward the internal fixed iron core 30.

However, since the related art solenoid has the structure in which the movable iron core 40 moves, the mass of the moving part is relatively large, resulting in a low reaction rate, namely, a slow response speed.

In addition, since the iron cores such as the movable iron core 40, the internal fixed iron core, and the external fixed iron core 10 are positioned around the coil 20, an electrical time constant (inductance/resistance) is so large that when a voltage is applied, a current increases relatively slowly.

Driving force of a solenoid is closely related to a magnitude of a current, and here, since a current may increase relatively slowly, it is difficult for the related art solenoid to obtain fast response characteristics.

SUMMARY

An aspect of the present disclosure may provide a high speed solenoid having fast response characteristics.

According to an aspect of the present disclosure, a high speed solenoid may include: a movable shaft linearly movable in an axial direction; a movable coil unit coupled to the movable shaft; and a magnetic field forming unit forming a magnetic field in a direction perpendicular with respect to that of a current flowing in the movable coil unit, wherein when a current is applied to the movable coil unit, the movable coil unit is moved by a magnetic field formed by the magnetic field forming unit to move the movable shaft.

The movable coil unit may include: a coil; a winding member allowing the coil to be wound therearound and formed by laminating a plurality of prepregs; and a movable support fixedly coupling the winding member to the movable shaft.

The magnetic field forming unit may include: a permanent magnet disposed within or outside of the movable coil unit and forming a magnetic field in a direction perpendicular with respect to that of a current flowing in the movable coil unit; and a first yoke and a second yoke connected by the permanent magnet, disposed within and outside of the movable coil unit, and concentrating magnetic flux of the magnetic field formed by the permanent magnet on the movable coil unit.

The first yoke and the second yoke may be connected to one side and the other side of the permanent magnet to form a magnetic flux path.

The high speed solenoid may further include: a guide unit surrounding the circumference of the movable shaft to guide a linear movement of the movable shaft.

The high speed solenoid may further include: a cover supporting the movable shaft and forming a movement space of the movable coil unit.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
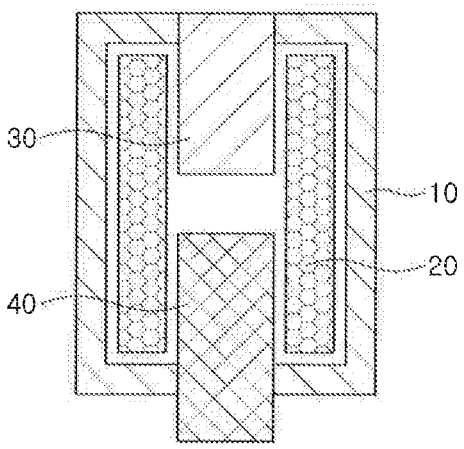
PRIOR ART FIG. 1
FIG. 1 is a cross-sectional view illustrating the related art solenoid.

Hereinafter, exemplary embodiments of the present disclosure will be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

First, a high speed solenoid according to an exemplary embodiment of the present disclosure will be described with reference to FIGS. 2 through 4. Here, FIG. 2 is a cross-sectional view illustrating a high speed solenoid according to an exemplary embodiment of the present disclosure, FIG. 3 is a cross-sectional view illustrating a state in which a movable coil unit of the high speed solenoid actuates, and FIG. 4 is a partially cross-sectional perspective view illustrating a winding member.

Figure 2:
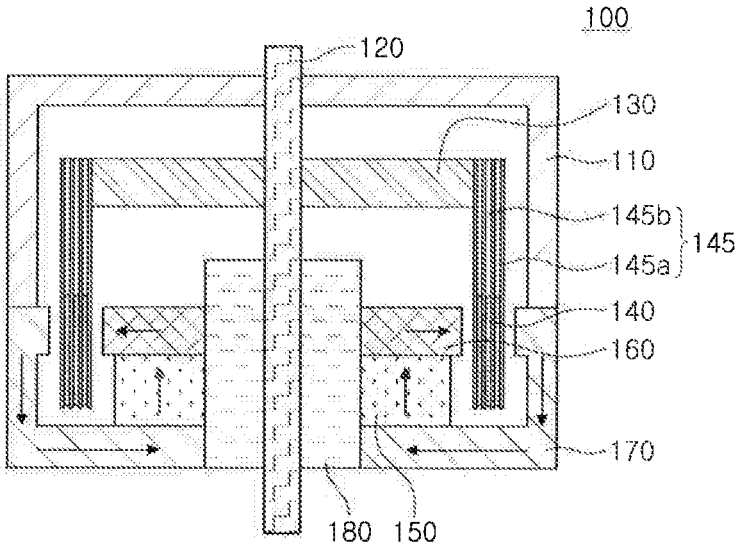
FIG. 2 is a cross-sectional view illustrating a high speed solenoid according to an exemplary embodiment of the present disclosure.
Figure 3:
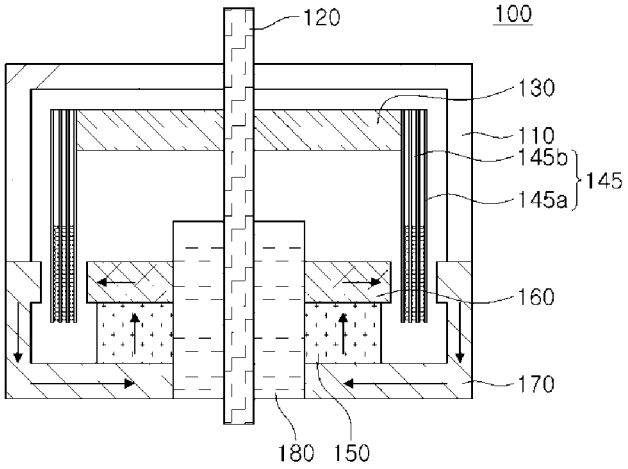
FIG. 3 is a cross-sectional view illustrating a state in which a movable coil unit of the high speed solenoid illustrated in FIG. 2 actuates.
Figure 4:
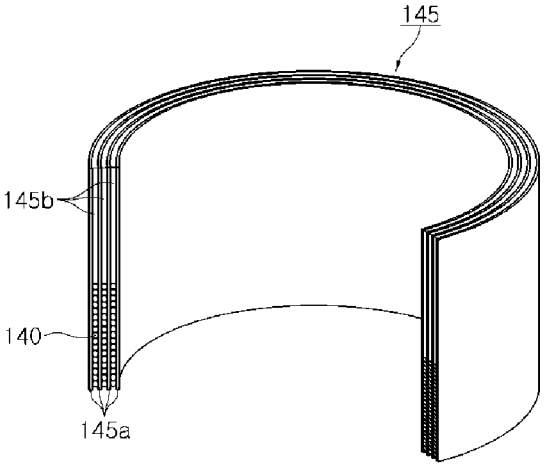
FIG. 4 is a partially cross-sectional perspective view illustrating a winding member included in the high speed solenoid illustrated in FIG. 2.

FIGS. 2 and 4, a high speed solenoid 100 according to an exemplary embodiment of the present disclosure may include a cover 110, a movable shaft 120, a movable coil unit, and a magnetic field forming unit, and may further include a guide unit 180 guiding a linear movement of the movable shaft 120.

The cover 110 may form a portion of a casing of the high speed solenoid 100 according to an exemplary embodiment of the present disclosure and may support the movable shaft 120 (to be described hereinafter) through a structure in which the movable shaft 120 is inserted into a hole.

In an exemplary embodiment, the cover 110 may form a movement space in which the movable coil unit is coupled with the magnetic field forming unit and moves.

As illustrated in FIGS. 2 and 3, the movable shaft 120 may be supported by the hole of the magnetic field forming unit (to be described hereinafter) and move in a linear manner in an axial direction.

The movable shaft 120 makes linear movements and transmits kinetic energy according to actuation of the high speed solenoid 100 according to an exemplary embodiment of the present disclosure to an external element.

The movable coil unit may be formed to move in a linear manner in an inner space of the cover 110. When the movable coil unit is coupled to the movable shaft 120 and moves in a linear manner, the movable coil unit may move the movable shaft 120.

In an exemplary embodiment, the movable coil unit may include a coil 140, a winding member 145, and a movable support 130.

The coil 140 may be formed as a conducting wire wound around the winding member 145 (to be described hereinafter), in which a current may flow.

The winding member 145 may be formed as an insulator around which the coil 140 is wound.

In an exemplary embodiment, the winding member 145 may have a cylindrical shape, in which the movable shaft 120 is disposed at the center of the winding member 145.

Also, in an exemplary embodiment, the winding member 145 may be formed by laminating a plurality of prepregs.

Prepreg is a material formed on reinforcing fibers pre-impregnated with a matrix material, and a plurality of prepregs may be bonded to form a high strength, lightweight material.

In an exemplary embodiment, as illustrated in FIG. 4, the winding member 145 may be formed such that a plurality of laminated prepregs 145*a* and 145*b* are spaced apart from one another, and the coil 140 may be wound in the space between the plurality of prepregs 145*a*.

Namely, the coil 140 may be wound from the center of the cylindrical winding member 145 in an outward direction a plurality of times to form multiple layers, and in this case, each of the wound layers of the coil 140 may be disposed between the plurality of prepregs 145*a*.

For this structure, in an exemplary embodiment, the winding member 145 may include a plurality of laminated main prepregs 145*a* and auxiliary prepregs 145*b* laminated between the main prepregs 145*a*.

As illustrated in FIG. 4, the auxiliary prepregs 145*b* have a length shorter than that of the main prepregs 145*a*, forming a space corresponding to the thickness of the coil 140 between the main prepregs 145*a*.

The structure in which the main prepregs 145*a* support each of the plurality of wound layers of the coil 140 on both sides is advantageous in that a coupling structure of the winding member 145 and the coil 140 is stable and the movable coil unit is formed to be thin and light.

Also, since each of the wound layers of the coil 140 is firmly inserted between the prepregs 145*a* and 145*b*, behaviors of the coil 140 and the winding member 145 may be consistent with each other.

The winding member 145 having the foregoing configuration may be formed to be lighter than a general coil bobbin, and thus, a driving unit may be lightweight to significantly enhance a response speed of the solenoid.

In particular, since the plurality of thin prepregs 145*a* and 145*b* are laminated to form the winding member 145, an overall thickness of the winding member 145 may be formed to be thin, reducing a space between a first yoke 160 and a second yoke 170 to be described hereinafter. The reduction in the space between the first yoke 160 and the second yoke 170 may lead to an increase in a magnetic field applied to the coil 140, increasing driving force of the solenoid to resultantly enhance a working speed of the solenoid.

The movable support 130 is a member fixedly coupling the winding member 145 to the movable shaft 120. In an exemplary embodiment, the movable support 130 may be formed as a member connected to one end of the winding member 145 at one outer side thereof and having the movable shaft 120 coupled to the hole thereof, but the present disclosure is not limited thereto.

The magnetic field forming unit may form a magnetic field in a direction perpendicular with respect to that of a current flowing in the movable coil unit.

In an exemplary embodiment, the magnetic field forming unit may include a permanent magnet 150, the first yoke 160, and the second yoke 170.

The permanent magnet 150 may be disposed within or outside of the movable coil unit and may form a magnetic field in a direction perpendicular with respect to that of a current flowing in the movable coil unit.

In an exemplary embodiment, as illustrated in FIGS. 2 and 3, the permanent magnet 150 may be provided on an inner side of the coil 140 provided in the movable coil unit.

The first yoke 160 and the second yoke 170 may be connected by the permanent magnet 150 and disposed within and outside of the movable coil unit, respectively, to enable magnetic flux of the magnetic field formed by the permanent magnet 150 to be concentrated on the movable coil unit.

In an exemplary embodiment, as illustrated in FIGS. 2 and 3, the first yoke 160 may be connected to one side of the permanent magnet 150 so as to be disposed at the inner side of the coil 140 and protrude toward the coil 140 at one end thereof.

As illustrated in FIGS. 2 and 3, the second yoke 170 may be connected to the other side of the permanent magnet 150 so as to be disposed outside of the coil 140 and protrude toward the coil 140 at one end thereof.

Through such a configuration, the coil 140 may be disposed between the first yoke 160 and the second yoke 170.

Here, the first yoke 160 and the second yoke 170 may be formed as magnets to form a magnetic flux path of magnetic flux generated by the permanent magnet 150.

In the configuration, the permanent magnet 150, the first yoke 160, and the second yoke 170 may form a magnetic field in a direction perpendicular with respect to that of a current flowing in the coil 140.

Namely, as indicated by the arrows in FIGS. 2 and 3, the permanent magnet 150, the first yoke 160, and the second yoke 170 may exert magnetic force on the coil 140 in a direction from the inner side of the coil to an outer side of the coil 140.

In this case, since magnetic flux may be concentrated on the coil 140 through the protruded structures of the first yoke 160 and the second yoke 170 toward the coil 140, strong magnetic force may act on the coil 140.

In this configuration, when a current is applied to the coil 140 of the movable coil unit, the movable coil unit is moved by a magnetic field formed by the magnetic field forming unit to move the movable shaft 120.

In other words, when a current is applied to the coil, the current flows in a vertical direction in the coil 140 within the magnetic field formed by the permanent magnet 150, the first yoke 160, and the second yoke 170 and the coil 140 may be moved in a linear manner upwardly by Lorentz force as illustrated in FIG. 3.

Although not shown, in an exemplary embodiment, an operation of returning the movable coil unit to its original position when the current supplied to the coil 140 is released may be implemented by an elastic member (not shown) such as a spring.

The guide unit 180 is formed to surround the circumference of the movable shaft 120 in an axial direction to guide a linear movement of the movable shaft 120. In an exemplary embodiment, the guide unit 180 may be formed as an insulator having a hole into which the movable shaft 120 is inserted and an outer edge thereof to which the permanent magnet 150, the first yoke 160, and the second yoke 170 are fixed.

Unlike the related art solenoid illustrated in FIG. 1, the moving part of the high speed solenoid 100 according to an exemplary embodiment of the present disclosure includes the lightweight coil 140 and the winding member 145, and thus, a response speed is fast.

Also, in the high speed solenoid 100 according to an exemplary embodiment of the present disclosure, since the coil 140 has low inductance, an electrical time constant is small, obtaining a fast response speed.

Other exemplary embodiments of the present disclosure will be described with reference to FIGS. 5 through 7. Here, FIGS. 5 through 7 are cross-sectional views illustrating other exemplary embodiments of the present disclosure, respectively.

Figure 5:
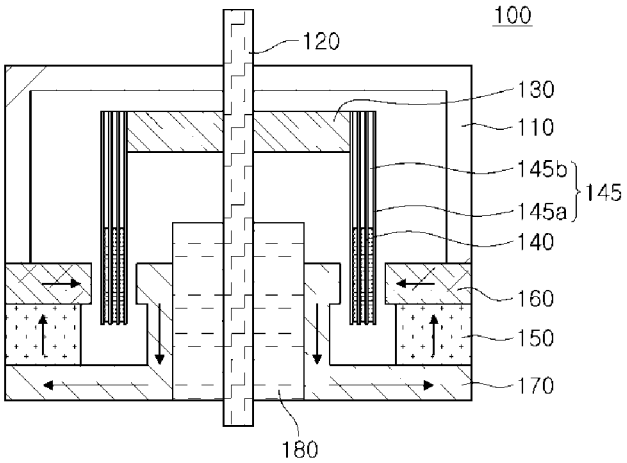
FIG. 5 is a cross-sectional view illustrating a high speed solenoid according to another exemplary embodiment of the present disclosure.

In a high speed solenoid 100 according to another exemplary embodiment of the present disclosure illustrated in FIG. 5, a permanent magnet 150 and a first yoke 160 may be disposed outside of a coil 140, unlike the high speed solenoid 100 according to the exemplary embodiment of the present disclosure described above with reference to FIGS. 2 and 3.

As illustrated in FIG. 5, in the high speed solenoid 100 according to another exemplary embodiment of the present disclosure, the movable support 130 is formed to be shorter and the winding member 145 and the coil 140 may have a smaller diameter, further reducing the weight of a moving part.

Figure 6:
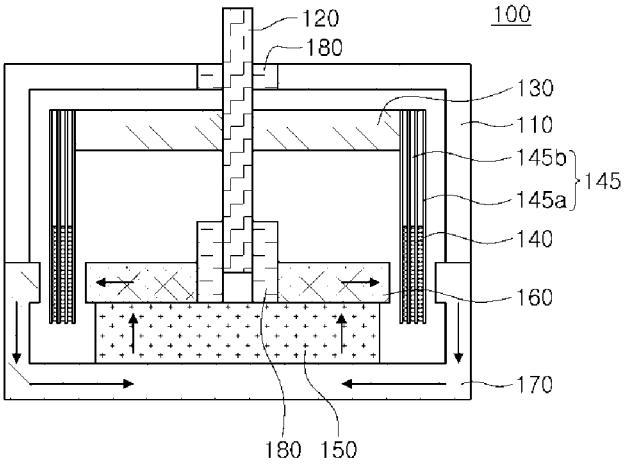
FIG. 6 is a cross-sectional view illustrating a high speed solenoid according to another exemplary embodiment of the present disclosure.
Figure 7:
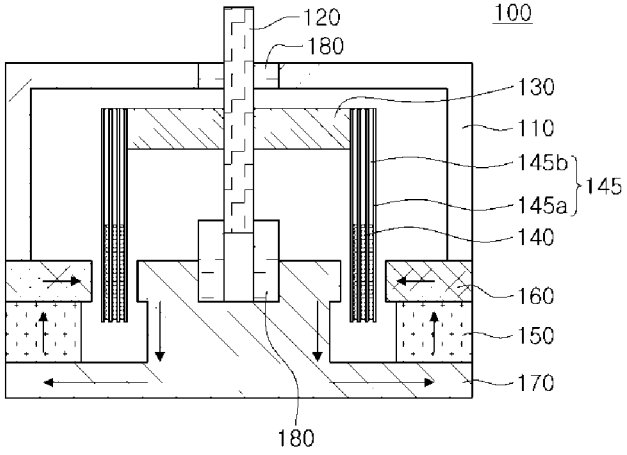
FIG. 7 is a cross-sectional view illustrating a high speed solenoid according to another exemplary embodiment of the present disclosure.

In a high speed solenoid 100 according to another exemplary embodiment of the present disclosure illustrated in FIG. 6, a movable shaft 120 may be formed to be short and not long enough to penetrate through a permanent magnet 150, a first yoke 160, and a second yoke 170 but only to be able to penetrate through the cover 110, unlike the high speed solenoid 100 according to the exemplary embodiment of the present disclosure described above with reference to FIGS. 2 and 3.

In the high speed solenoid 100 according to another exemplary embodiment of the present disclosure illustrated in FIG. 6, since the weight of the movable shaft 120 is reduced, the weight of a moving part is further reduced.

In a high speed solenoid 100 according to another exemplary embodiment of the present disclosure illustrated in FIG. 7, a permanent magnet 150 and a first yoke 160 may be disposed outside of a coil 140, unlike the high speed solenoid 100 according to the exemplary embodiment of the present disclosure illustrated in FIG. 5.

In the high speed solenoid 100 according to another exemplary embodiment of the present disclosure illustrated in FIG. 7, the movable support 130 may be formed to be short, a winding member 145 and the coil 140 may have a small diameter, and a movable shaft 120 may be formed to be short, the weight of a moving part may be significantly reduced.

As set forth above, according to exemplary embodiments of the present disclosure, the weight of a moving part may be significantly reduced, and since an electrical time constant is small, a response speed of the solenoid may be enhanced.

In addition, since the moving part disposed in a magnetic field is thin, driving force may be increased, enhancing a response speed.

While exemplary embodiments have been shown and described above, it will be apparent to those skilled in the art that modifications and variations could be made without departing from the scope of the present invention as defined by the appended claims.

What is claimed is:

1. A high speed solenoid comprising:

a movable shaft linearly movable in an axial direction;

a movable coil unit coupled to the movable shaft; and a magnetic field forming unit forming a magnetic field in a direction perpendicular with respect to that of a current flowing in the movable coil unit, wherein the magnetic field forming unit includes a permanent magnet, a first yoke, and a second yoke, the first yoke being connected to one side of the permanent magnet and the second yoke being connected to an opposing side of the permanent magnet, wherein when a current is applied to the movable coil unit, the movable coil unit is moved by a magnetic field formed by the magnetic field forming unit to move the movable shaft, wherein the movable coil unit comprises a coil, a winding member allowing the coil to be wound there around and formed by laminating a plurality of prepregs, and a movable support fixedly coupling the winding member to the movable shaft, and wherein the permanent magnet is disposed inside a space defined by the winding member, and wherein the plurality of prepregs of the winding member are spaced apart from one another, and the coil is wound in the space between the plurality of prepregs.

2. The high speed solenoid of claim 1, wherein the winding member comprises a plurality of laminated main prepregs and a plurality of auxiliary prepregs laminated between the main prepregs such that the space is formed between the plurality of main prepregs to allow the coil to be wound therein.

3. The high speed solenoid of claim 2, wherein the auxiliary prepregs have a length that is shorter than a length of the main prepregs allowing the space to be formed between the main prepregs.

4. The high speed solenoid of claim 1, wherein the magnetic field forming unit comprises:

a permanent magnet disposed within or outside of the movable coil unit and forming a magnetic field in a direction perpendicular with respect to that of a current flowing in the movable coil unit; and a first yoke and a second yoke connected by the permanent magnet, disposed within and outside of the movable coil unit, and concentrating magnetic flux of the magnetic field formed by the permanent magnet on the movable coil unit.

5. The high speed solenoid of claim 4, Wherein the first yoke and the second yoke are connected to one side and the other side of the permanent magnet to form a magnetic flux path.

6. The high speed solenoid of claim 1, further comprising a guide unit surrounding the circumference of the movable shaft to guide a linear movement of the movable shaft.

7. The high speed solenoid of claim 1, further comprising a cover supporting the movable shaft and forming a movement space of the movable coil unit.

8. The high speed solenoid of claim 1, wherein the space is formed between adjacent prepregs.

9. The high speed solenoid of claim 1, wherein the prepregs are arranged concentrically with respect to one another.

10. The high speed solenoid of claim 1, wherein a plurality of spaces are formed between a plurality of adjacent prepregs, and the coil is wound in the plurality of spaces.

11. The high speed solenoid of claim 1, wherein the coil is wound in a plurality of layers, each of the layers being disposed between the plurality of prepregs.

12. The high speed solenoid of claim 1, wherein the prepregs support each of the plurality of wound layers of the coil on both sides.

13. The high speed solenoid of claim 1, wherein the coil is firmly inserted between the prepregs.

14. The high speed solenoid of claim 1, wherein the space between the prepregs corresponds to the thickness of the coil.

* * * * *